US006659294B1

(12) United States Patent
Simard

(10) Patent No.: US 6,659,294 B1
(45) Date of Patent: Dec. 9, 2003

(54) MULTI-CONFIGURATIONAL WIRE-ROD DISPLAY RACK

(75) Inventor: Gilles Simard, LeGardeur (CA)

(73) Assignee: Cari-All Inc., Montreal (CA)

( * ) Notice: Subject to any disclaimer, the term of this patent is extended or adjusted under 35 U.S.C. 154(b) by 0 days.

(21) Appl. No.: 10/300,857

(22) Filed: Nov. 19, 2002

Related U.S. Application Data

(63) Continuation of application No. 09/810,924, filed on Mar. 16, 2001, now abandoned.

(51) Int. Cl.[7] ..... A47F 5/14

(52) U.S. Cl. ..... 211/181.1; 211/187; 211/186; 108/147.11

(58) Field of Search ..... 211/187, 90.03, 211/90.04, 181.1, 189, 192, 134, 186, 207, 106, 208; 280/79.3; 108/107, 144.11, 147.11–147.13, 147.16, 147.17, 147.15; D6/396, 462, 458, 566–567, 569, 570, 573–574

(56) References Cited

U.S. PATENT DOCUMENTS

| | | | | | |
|---|---|---|---|---|---|
| D122,462 | S | * | 9/1940 | Griffin | D6/464 |
| D123,432 | S | * | 11/1940 | Kneebone | D6/464 |
| 2,315,595 | A | * | 4/1943 | Chappory | 211/186 |
| D140,635 | S | | 3/1945 | Bartel | |
| D167,395 | S | * | 8/1952 | Dunn | D6/465 |
| 2,680,522 | A | | 6/1954 | Temple | |
| 2,761,568 | A | * | 9/1956 | Temple | 108/59 |
| 3,007,708 | A | | 11/1961 | Ochs | |
| 3,085,694 | A | * | 4/1963 | Jones | 211/134 |
| D207,437 | S | * | 4/1967 | Oliver | D6/465 |
| 3,435,958 | A | * | 4/1969 | Chesley | 211/133.2 |
| 3,487,951 | A | | 1/1970 | Beltzung | |
| 3,680,712 | A | | 8/1972 | Jurasek | |
| 3,977,529 | A | | 8/1976 | Stroh | |
| 4,045,043 | A | | 8/1977 | Fourrey | |
| 4,099,735 | A | | 7/1978 | Becker, III | |
| 4,180,277 | A | | 12/1979 | Romero | |
| 4,391,378 | A | * | 7/1983 | Secon | 211/187 |
| 4,546,887 | A | | 10/1985 | Cohn | |
| 4,627,672 | A | | 12/1986 | DeBruyn | |
| 4,960,214 | A | | 10/1990 | Sayers | |
| 4,978,013 | A | | 12/1990 | Hogg | |
| 4,986,555 | A | | 1/1991 | Andreen | |
| 5,027,959 | A | | 7/1991 | Luukkonen | |
| 5,218,914 | A | * | 6/1993 | Dickinson | 108/64 |
| 5,251,973 | A | | 10/1993 | Hazan | |
| 5,253,770 | A | | 10/1993 | Rosenthal | |
| 5,326,062 | A | | 7/1994 | Remmers | |
| 5,573,124 | A | | 11/1996 | Frost | |
| 5,685,236 | A | | 11/1997 | Lechman | |
| 5,718,441 | A | | 2/1998 | Kern et al. | |
| 5,913,270 | A | * | 6/1999 | Price | 108/101 |
| 5,947,307 | A | * | 9/1999 | Battaglia et al. | 211/187 |
| 5,988,409 | A | | 11/1999 | Gusdorf et al. | |
| 6,089,387 | A | | 7/2000 | Varfolomeeva | |
| 6,173,847 | B1 | | 1/2001 | Zellner, III et al. | |
| 6,241,107 | B1 | | 6/2001 | Boyer | |
| 6,286,693 | B1 | | 9/2001 | Brown | |
| 6,364,137 | B1 | * | 4/2002 | Glauth et al. | 211/186 |

* cited by examiner

*Primary Examiner*—Daniel P. Stodola
*Assistant Examiner*—Jennifer E Novosad
(74) *Attorney, Agent, or Firm*—Snedler & Monteith

(57) ABSTRACT

A multi-configurational wire-rod display rack has one or more display modules which have at least two vertical side frames provided with two spaced-apart vertically extending posts. A plurality of transverse horizontal attachment rods are removably secured between the posts of the end frames. The posts are interconnected at a top end by a transverse top horizontal member. The vertical side frames are interconnected together in spaced, parallel relationship by lower connecting cross-bars secured between a respective common one of the end posts of the pair of side frames, and a top connecting cross-bar secured between the transverse top horizontal members of the vertical side frames. A plurality of wire-rod product support-and-display accessories are removably supported between the attachment rods and span the at least two vertical side frames. A plurality of these racks may be disposed side-by-side to form a large flexible display structure.

16 Claims, 9 Drawing Sheets

MULTI-CONFIGURATIONAL WIRE-ROD DISPLAY RACK

RELATED APPLICATION

This application is a continuation of U.S. patent application Ser. No. 09/810,924, filed on Mar. 16, 2001 now abandoned.

TECHNICAL FIELD

The present invention relates to a multi-configurational wire-rod display rack comprised of modules of different sizes interconnectable together and wherein the rack may be accessible from opposed sides and/or opposed ends thereof and includes selected ones of a multitude of product support and display accessories.

BACKGROUND ART

Wire display racks are known for various utilities. For example, such racks are utilized in produce display for refrigerated display cases to display produce and other products requiring refrigeration. U.S. Pat. No. 3,680,712 also describes a modular display rack which is constructed of wire rod and including a plurality of disconnectable rack sections to permit the size and capacity of the rack assembly to be selectively varied. It also comprises side frame members which support removable shelving. However, with the majority of these wire rod display racks, the rack is not entirely formed of wire rod shelving or support frames and these are difficult to assemble and clean and require considerable time to modify. Furthermore, most of these racks are not accessible from all sides thereof, are difficult to ship and convert to adapt to specific customer needs. Once the racks are installed they are not very versatile and most of these display only on a single side and do not provide high visibility. These racks cannot be classified as systems having a high degree of versatility.

With prior art wire rod display rack structures, it is often necessary to supply fasteners to secure support shelving therein. Often, these fasteners become lost and render the rack or sections thereof unusable. Some of these racks are also not sturdy and eye pleasing.

SUMMARY OF INVENTION

It is therefore a feature of the present invention to provide a multi-configurational wire display rack which overcomes the disadvantages of the prior art and which is flexible, easy to erect, modify and relocate, easy to clean, which provides excellent visibility by permitting light to go through the entire display rack and which readily adapts to customer needs by simple replacement of the product support-and-display accessories without the need of fasteners.

Other features of the multi-configurational wire display rack of the present invention include its simplification, ease of assembly and installation, components which adapt easily, can be used in many applications such as retail, industrial, medical etc., is easy to clean, versatile, etc. . . .

According to the above feature of the present invention there is provided a multi-configurational wire-rod display rack which comprises one or more display modules each having at least two vertical side frames having two spaced-part vertically extending posts. A plurality of transverse horizontal attachment rods are immovably secured between the posts of the end frames. The posts are interconnected at a top end by a transverse top, horizontal member. The vertical side frames are interconnected together in spaced, parallel relationship by lower connecting cross-frames secured between a respective common one of the end posts of the pair of vertical end posts, and a top interconnecting means secured between the transverse top horizontal members of the vertical side frames. A plurality of wire-rod product support-and-display accessories are removably supported between the attachment rods without the use of fasteners and span the at least two vertical side frames.

Other features of the present invention can be summarized as follows: A display rack system which provides quick field assembly as compared to any gondola manufacturer, the system has many versatile features, such as: add, reverse, slope and shelf. The system is modular in that all components work together to create a total system with several options such as: wire peg boards, wing racks and baskets. The system can be used as an island display or gondola run of shelving. The system also displays in opposed directions and end-to-end. The sloped shelves can create gravity feed or high visibility of products. The shelves are also quick and easy to adjust. The shelves have a suspension design with structural trussing for additional strength characteristics. They also have a unique locking design feature which prevents the shelves from disengaging upon impact.

BRIEF DESCRIPTION OF DRAWINGS

A preferred embodiment of the present invention will now be described with reference to the accompanying drawings in which.

DESCRIPTION OF PREFERRED EMBODIMENTS

Figure 1:
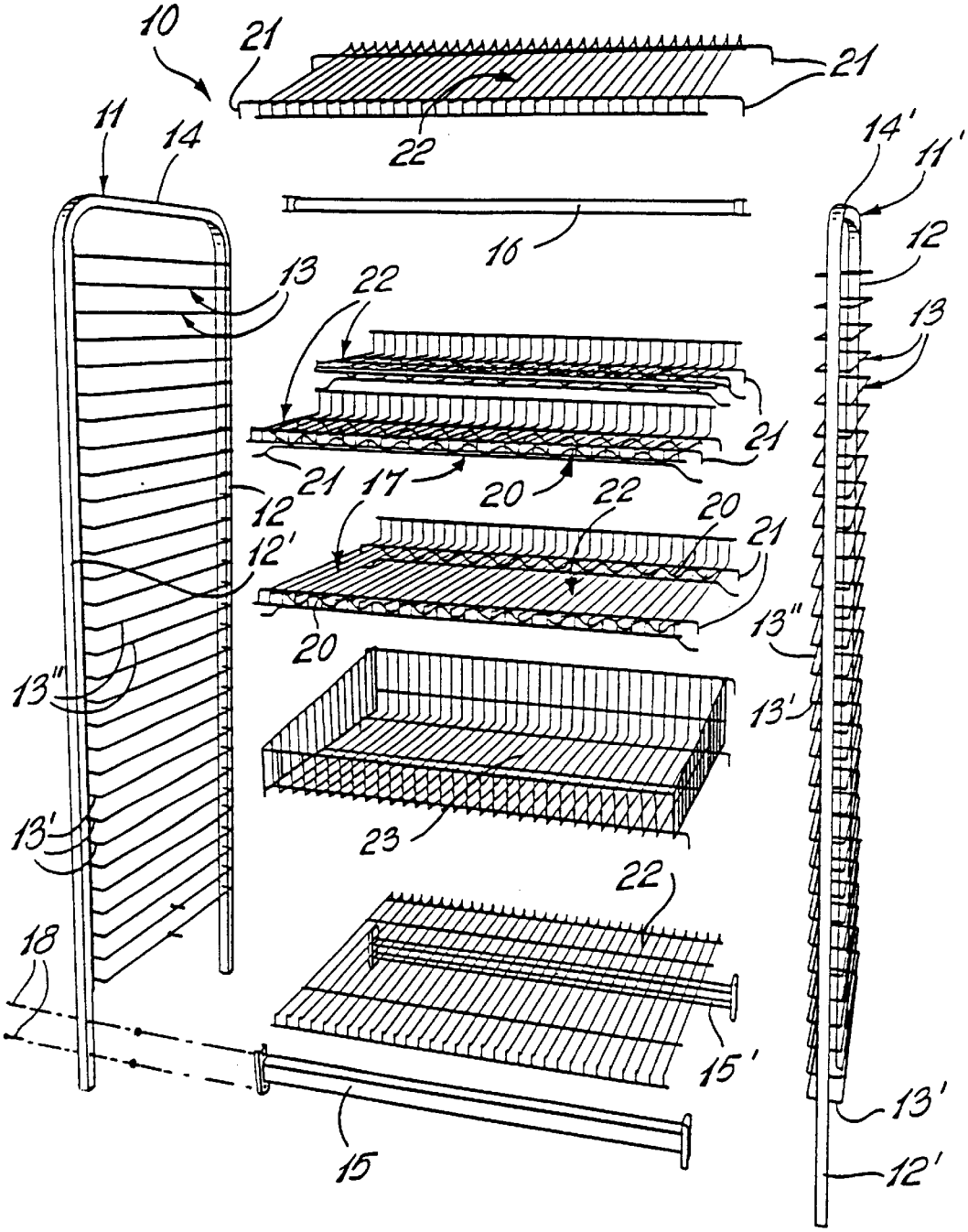
FIG. 1 is an exploded perspective view showing the multi-configurational wire display rack module constructed in accordance with the present invention and utilizing a variety of product support-and-display accessories removably supported thereby.
Figure 2:
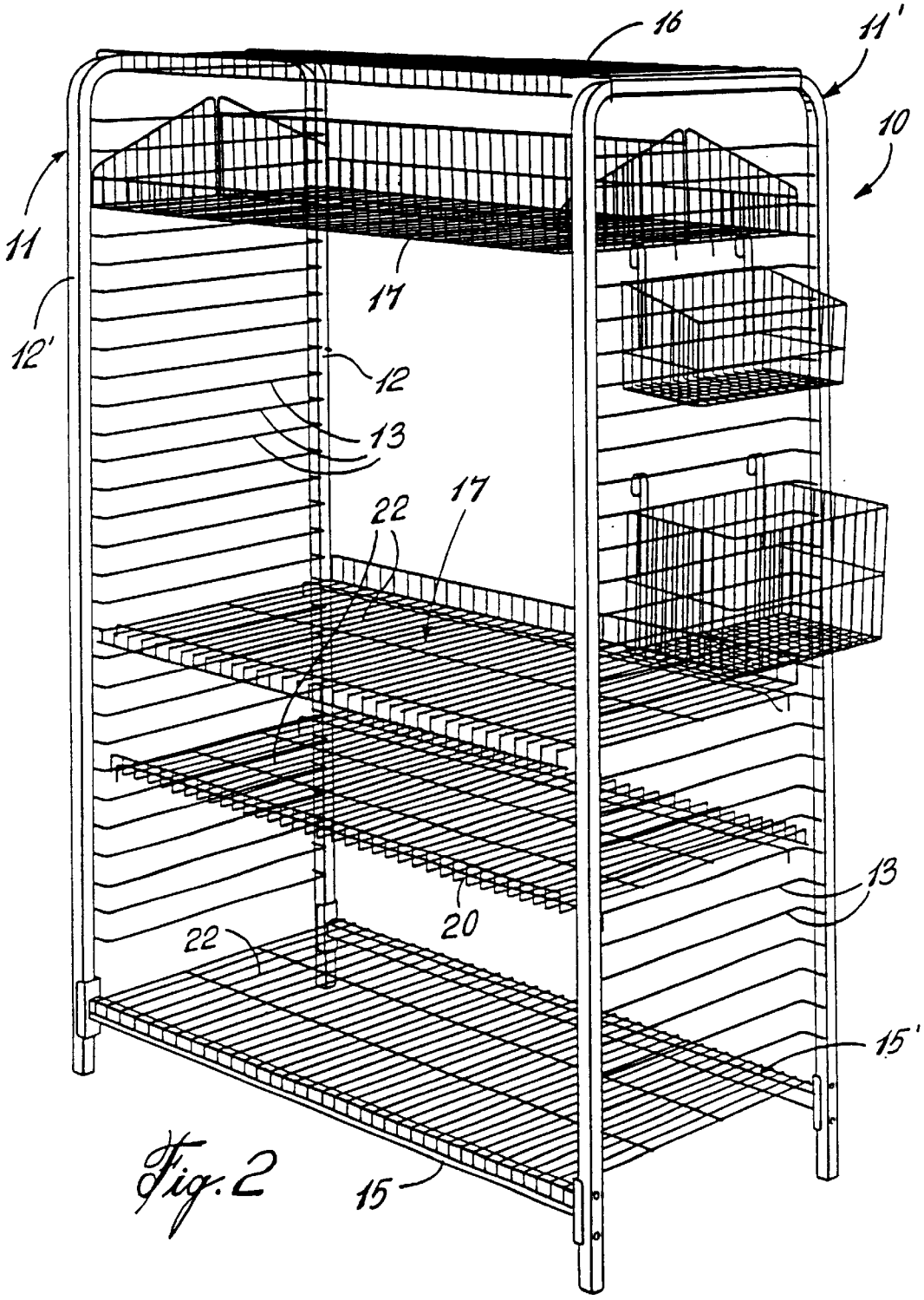
FIG. 2 is a perspective view showing the multi-configurational wire display rack module constructed in accordance with the present invention and also having product support-and-display accessories secured thereto and to the side frames thereof.
Figure 3:
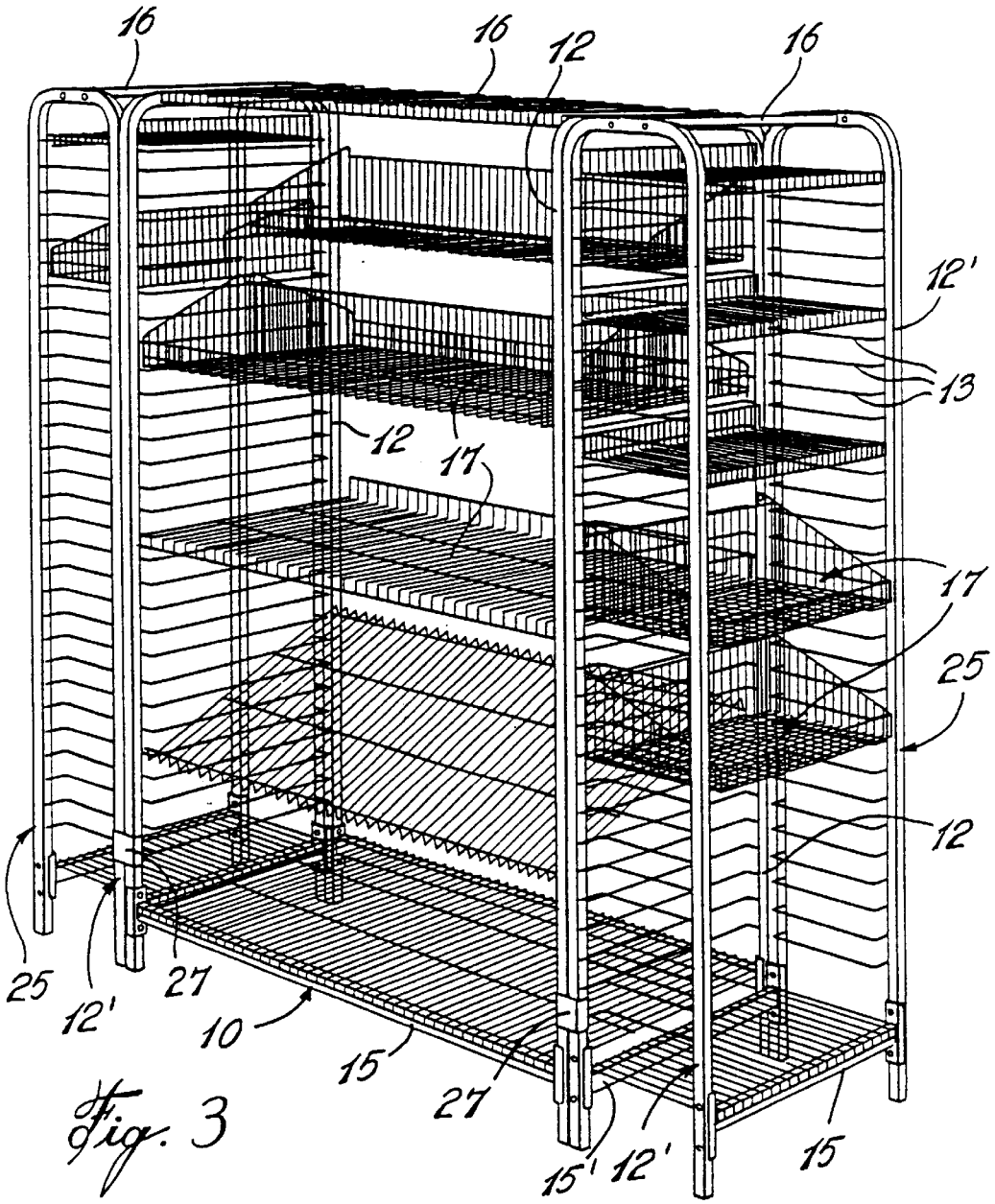
FIG. 3 is a further perspective view showing the multi-configurational wire display rack module of the present invention and provided with small transverse end modules secured thereto.

Referring now to the drawings and more particularly to FIG. 1, there is shown generally at 10, a multi-configurational wire display rack constructed in accordance with the present invention. This rack is better illustrated in FIG. 2 in its assembled form. As hereinshown the rack consists of a display module which is formed by at least two vertical side frames 11 and 11' having two spaced apart vertically extending posts 12 and 12'. A plurality of transverse horizontal attachment rods 13 are immovably secured between the rearward posts 12 and the forward post 12'. The side posts 12 and 12' are interconnected at a top end by a transverse horizontal member, herein constituted by an integrally formed transverse portion 14 of a rigid tubular rod constituting the vertically extending posts 12 and 12' and the transverse top horizontal member 14. This structure constitutes the vertical side frames 11 and 11'.

The vertical side frames 11 and 11' are interconnected together in spaced parallel relationship by lower connecting cross-bars 15 and 15' secured between a respective common one of the end posts 12 and 12' of the pair of vertical end posts. The vertical side frames are interconnected at a top end by connecting means in the form of a top connecting cross-bar 16 secured between the transverse top horizontal members 14 and 14'. A plurality of wire-rod product support-and-display accessories 17 are It is pointed out that the tubular rod of the side frames as well as the lower and top cross-bars may be formed of hollow tubular rods of square cross-section although not limited to this specific cross-sectional configuration, as will be described later with respect to the U-shape cross-section lower cross-bars. The top cross-bar can also act as a hanging bar for clothing or other use. The top and bottom cross-bars are also interconnected to the side frames by bolts 18 or other type fasteners capable of providing for ease and rapidity of installation and removal.

As shown more clearly in FIG. 1, the horizontal attachment rods 13 are elongated U-shaped rods defining opposed short right angle end sections 13' and an elongated intermediate straight section 13". The short end sections 13' are connected to a respective one of the two spaced-apart vertically extending posts 12 and 12' with the intermediate straight sections 13" disposed to one side of the vertically extending posts 12 and 12' and projecting slightly therefrom as can be seen from the lower end section of the right-hand vertical side frame 11' illustrated in FIG. 1. These straight sections project a predetermined distance from the vertically extending posts 12 and 12' to provide a clearance gap for insertion of the support-and-display accessories 17 secured between the two vertical side frames. As also shown, the horizontal attachment rods 13 are disposed in spaced parallel relationship and extend a predetermined distance spaced from the transverse top horizontal member 11 and terminate just above the connection of the lower connecting cross-bars 15. The cross-bars 15 and 15' are U-shaped channels with the U disposed inwardly facing one another. Accordingly, the lower flange 15" of the cross-bars can support a shelf such as shelf 22'.

Figure 4:
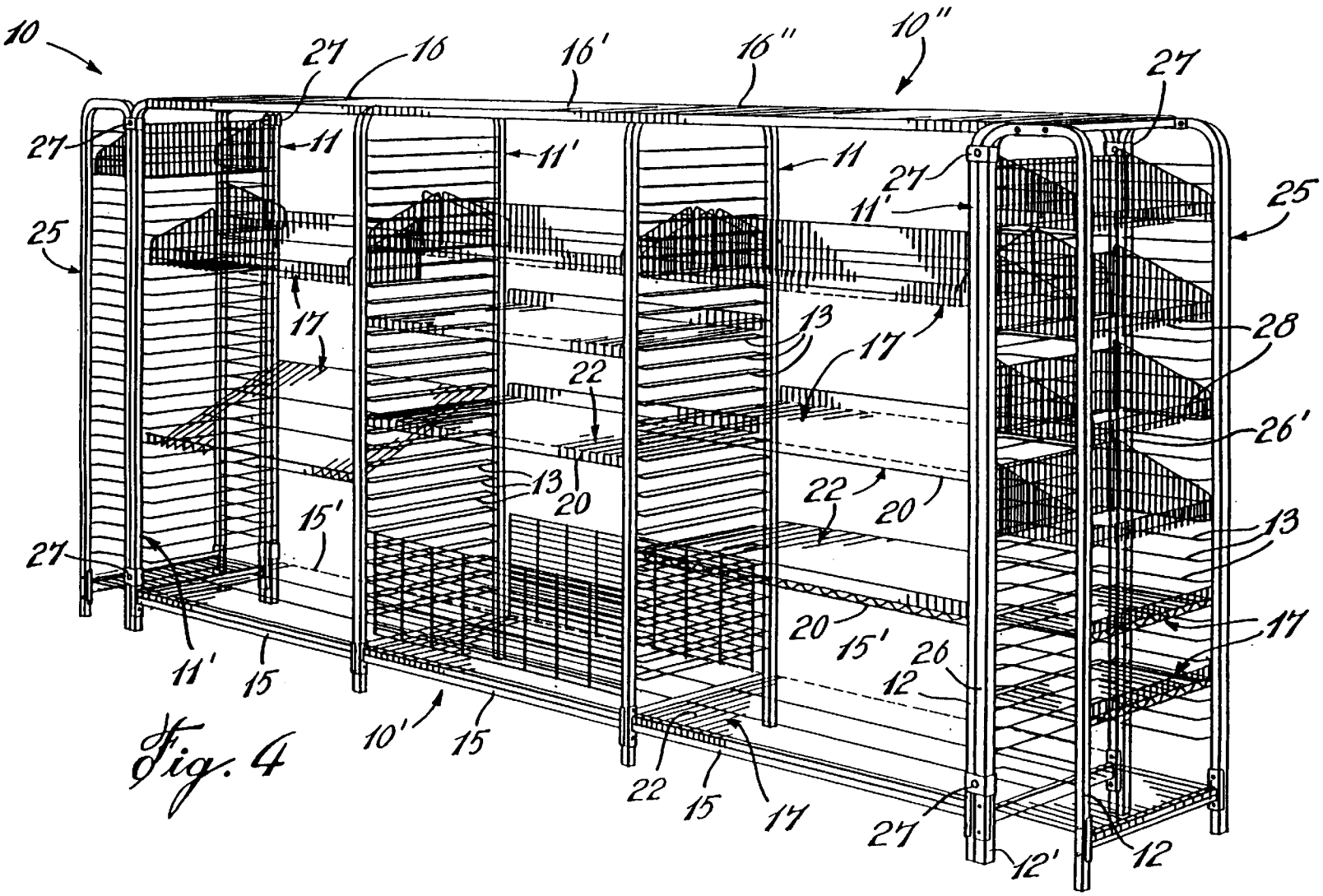
FIG. 4 is a perspective view of a multi-configurational wire display rack having a plurality of modules and interconnected small end modules.

As illustrated in FIG. 1, the right-hand vertical side frame is herein shown as an intermediate side frame 11' and it is used in a two or more module display rack as illustrated more clearly in FIG. 4. The intermediate side frame 11' is provided with horizontal attachment rods 13 projecting from opposed sides thereof with the rods aligned with one another in horizontal parallel relationship.

As shown in FIG. 4, the display rack modules 10, 10' and 10" are interconnected together by the top connecting bars 16, 16' and 16" and the lower connecting cross-bars 15 and 15' of each module. The illustration in FIG. 4 shows different types of product support-and-display accessories 17 with some of the shelves such as 17' being angularly and removably supported in one of the modules 10. These accessories are all wire rod formed accessories with cross-rods welded together at their intersections, as is well known in the art, and some of the shelving may be provided with zig-zag reinforcing transverse end ribs 20 as is better shown in FIG. 1. Further, all of these accessories are integrally formed with wire hook ends 21 which may vary in configuration depending on the accessory and its interconnection within the module. These accessories may be constituted by various types of shelving 22 or baskets 23 or other accessories as will be described later on but the present invention is not intended to be limited to any of these specific accessories.

Referring again to FIG. 4, there is shown the construction of a small display module 25 which is constructed exactly as the modules 10 but of a much smaller size and dimensioned in length to be equal to the width of the modules 10. These small end modules 25 are hereinshown as disposed transversely against and outwardly of one or both vertical side frames 11' of the display rack module 10" or 10. The end modules are aligned with a common one of the posts herein identified by numerals 26 and 26' of the frames of the display module 25 disposed side-by-side with an associated one of the two spaced-apart vertically extending posts 11' and 11 of the display rack module 10". These adjacently disposed posts 11 and 26 and 11' and 26' may be interconnected together by removably securable clamps 27 which may be snap-fit connected or otherwise clamps opposed vertical posts. The clamps interconnect adjacent modules 10 and end modules 25.

The end display modules 25 also have smaller sized product support-and-display accessories 28 supported between its attachment rods 13. As previously described, these end racks are of the same construction as the main rack modules 10 but of much smaller size and provide for an end display.

Figure 5:
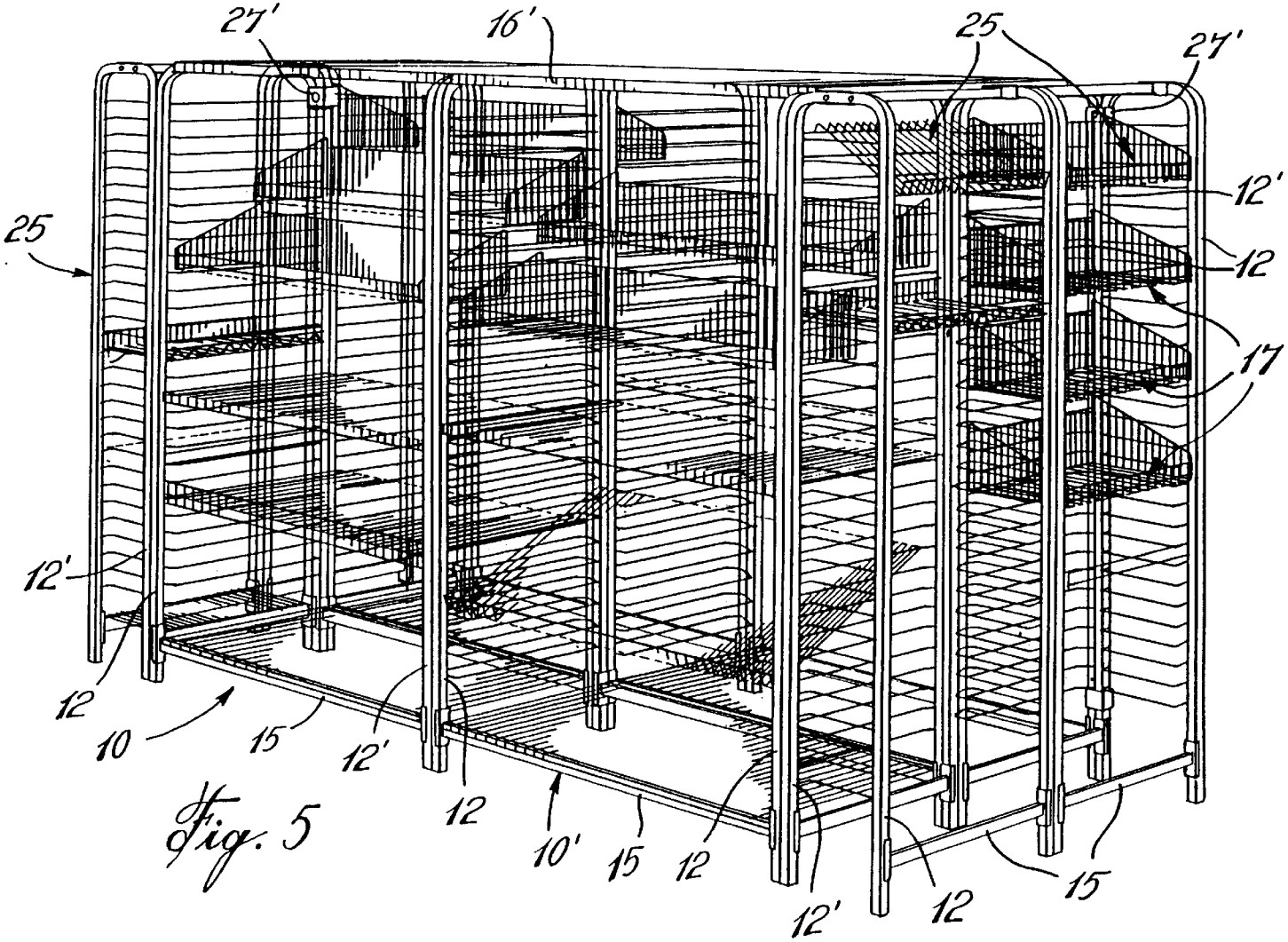
FIG. 5 is a further perspective view showing a multi-configurational wire display rack comprising a plurality of display modules and small end modules interconnected together and accessible from all four sides.

As shown in FIG. 5, two of the multi-configurational wire display racks as shown in FIG. 4 are interconnected together in side-by-side relationship by further clamps 27' although not essential, which are conveniently positioned along adjacent vertical extending posts 12 and 12'. The display rack structure as shown in FIG. 5 is a very large structure and is accessible from all four sides. As can readily be seen, because the display rack is constructed of wire-rod accessories, light easily permeates through the entire rack making all of the articles visible. Also, because articles intended to be positioned thereon all have different type and coloured packaging, it makes the entire display rack very attractive. Another important feature of such large wire display rack structures, as shown in FIG. 5, is that the accessories of each of the modules can be independently modified by simply removing the accessories and replacing them with another type of accessory to either divide a shelf section, provide a different type shelf, convert the shelf into a peg board, or simply move the accessories to different locations. Flexibility of the wire display rack as shown in FIG. 5 is practically unlimited.

Figure 6:
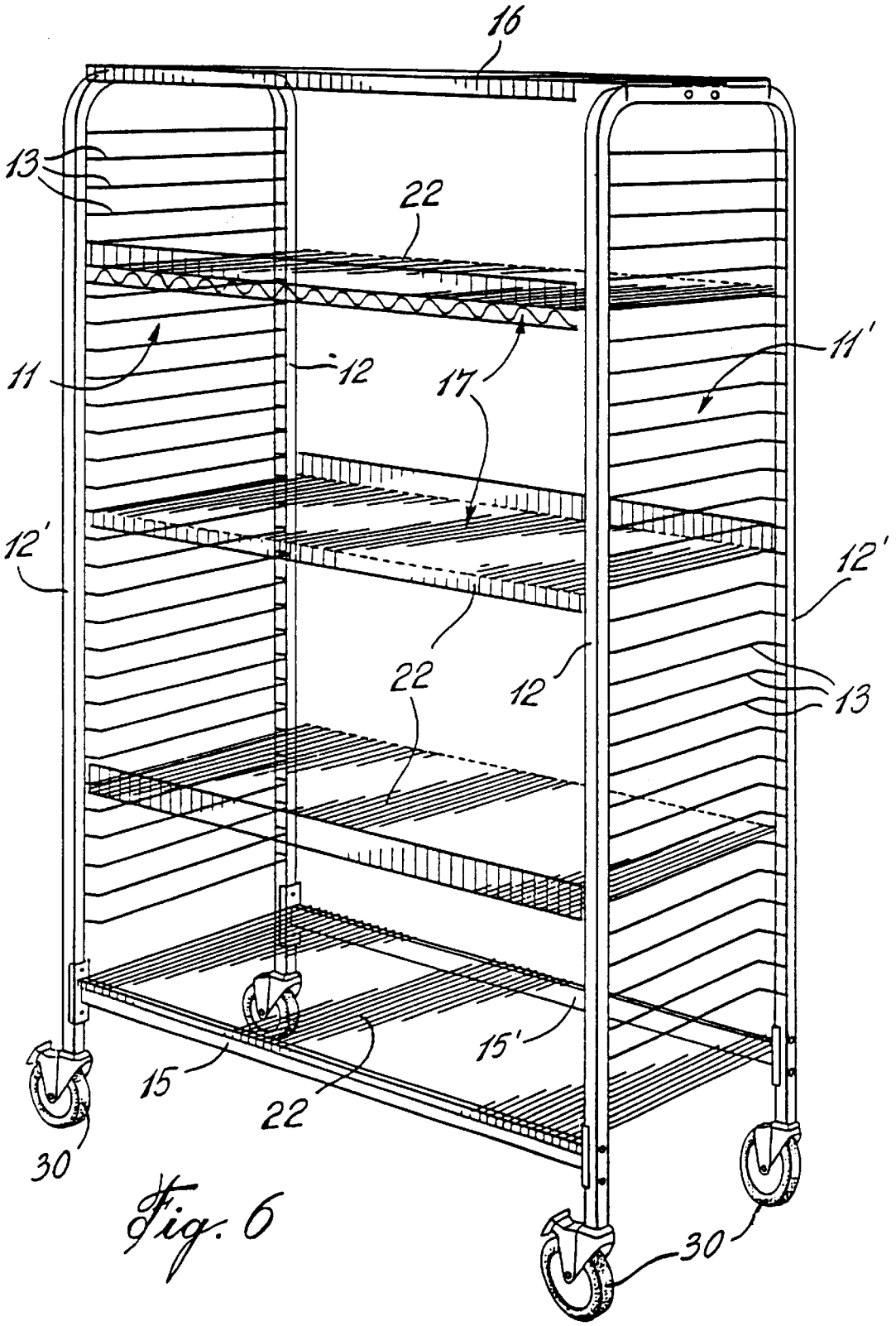
FIG. 6 is a perspective view similar to FIG. 2 but showing the module supported on casters for displacement thereof.

Another use of the multi-configurational wire display rack module 10 of the present invention is illustrated in FIG. 6.

As hereinshown, casters 30 are secured to the bottom of the vertically extending posts 12 and 12' of each of the vertical side frames 11 and 11' whereby to construct a mobile display rack or a mobile dolly for use in transporting various type products such as for use in hospitals, grocery marts, etc. Of course, solid wall trays or boxes may be positioned on the shelving 22 of the mobile rack. The casters may also be provided with brakes.

Figure 7A:
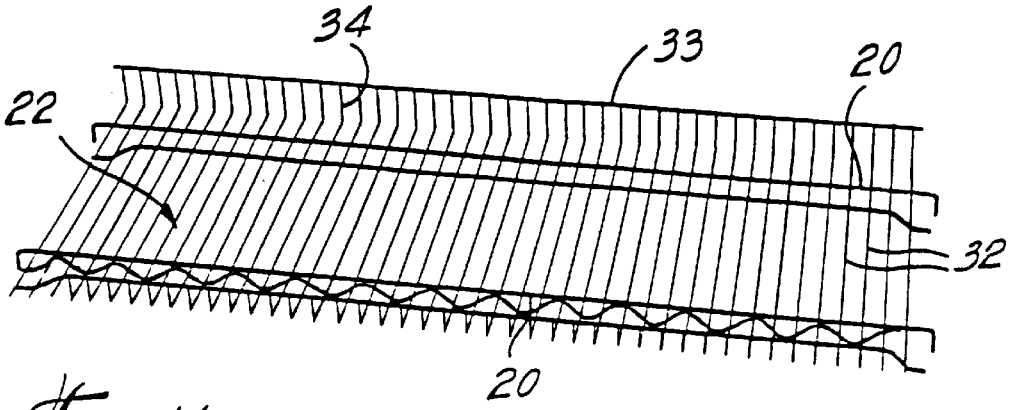
FIG. 7A is a perspective view showing the construction of a shelf accessory for securing within the module and provided with integrally formed wire hooks.
Figure 7B:
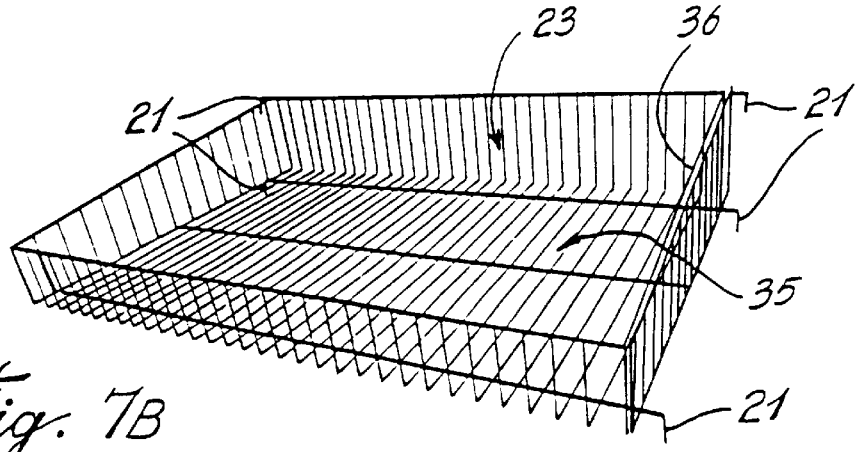
FIG. 7B is a perspective view showing the construction of a basket-type accessory.
Figure 7C:
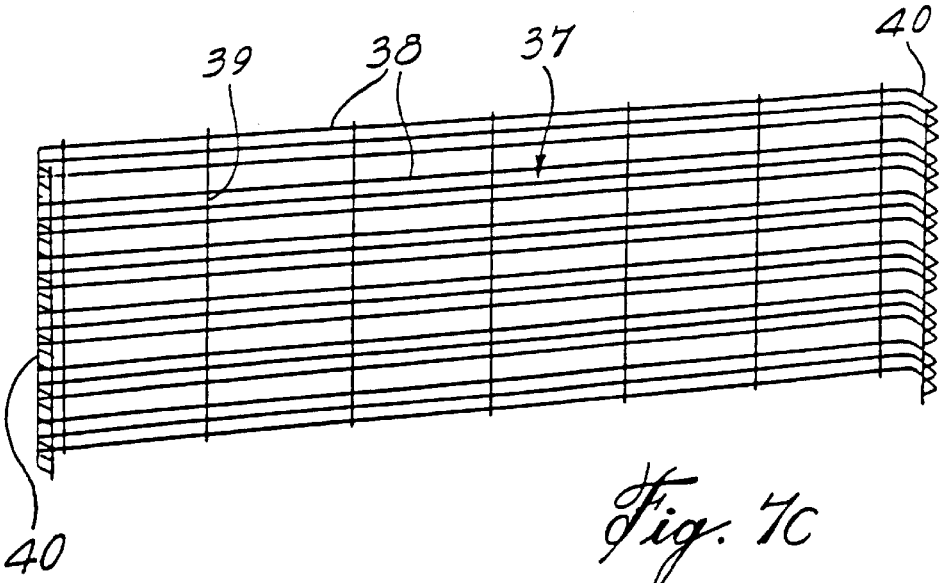
FIG. 7C is a perspective view showing the construction of a wire rod peg board accessory.

With reference now to FIGS. 7A to 7C, there is shown the construction of specific accessories although a multitude of these may be provided. As shown in FIG. 7A, the shelving 22 is formed by a plurality of parallel spaced wire rods 32 welded together at their junctions with the re-enforcing transverse zig-zag ribs 20 and cross-rods 33 at their respective ends. These reinforcing zig-zag ribs 20 provide rigidity for shelves having long spans between the attachment rods 13. As hereinshown, the rear end of the shelf has an upturned wire wall 34.

In FIG. 7B, there is shown the construction of a shallow wire rod basket 23 and like the shelf 22, it is provided with integrally formed hook ends 21 for attachment to the horizontal attachment rods 13. Hook ends are also formed with the bottom wall 35 of the basket as well as the top edge 36 to provide attachments at the bottom and top level.

FIG. 7C shows a wire formed peg board 37 and it is formed of a plurality of spaced apart horizontally disposed wire rods 38 and transverse rods 39 welded together. These peg boards can be attached either horizontally or vertically within the frame by various attachment means or integrally formed hooks or inturned end wall sections 40.

Figure 8A:
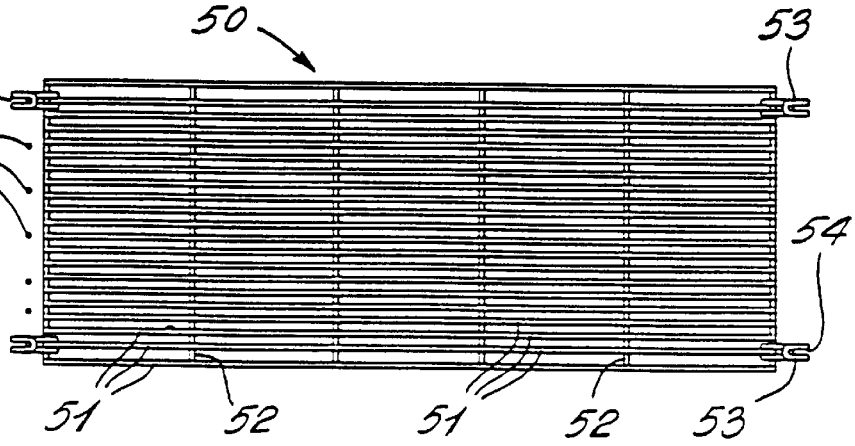
FIG. 8A is a plan view of a further peg board accessory.
Figure 8B:
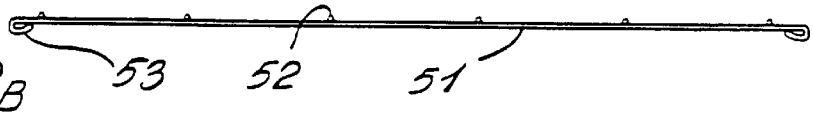
FIG. 8B is a top view of FIG. 8A.

Referring to FIGS. 8A and 8B there is shown the construction of a further wire formed peg board 50. As hereinshown the peg board is formed by a plurality of spaced apart horizontally disposed wire rods 51 and transverse rods 52 welded together at their intersection. Some of these horizontal rods 51 or U-shaped hooks 53, formed of wire rods sections, are also welded adjacent opposed corners of the rectangular peg board 50. These U-shaped hooks define a mouth opening 54 whereby to receive therein the transverse horizontal attachment rods 13 of the side frames. Accordingly, it can be seen that the peg board 50 can be disposed at any location along opposed side frames 11 and 11' and at any depth between the side posts 12 and 12'. Various support rods or brackets (not shown) are removably secured to the peg board to support stacked articles thereon. These peg boards can also be secured over the lower connecting rods cross-bars 15 between the attachment rods 13 to form a lower basket over the bottom shelf 22'.

Figure 9B:
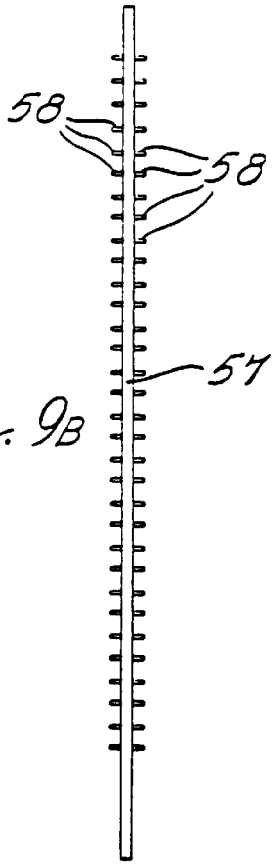
FIG. 9B is a side view of FIG. 9A.
Figure 9A:
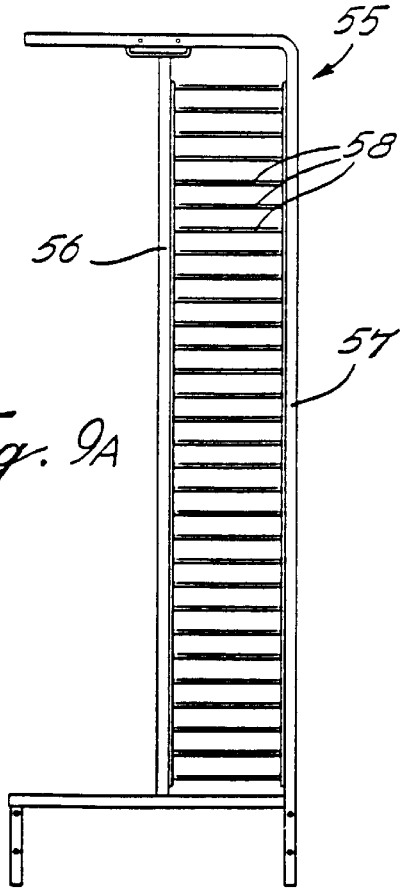
FIG. 9A is a plan view of a vertical side frame provided with transverse attachment rods in a half portion only of the space between the opposed side posts.

FIGS. 9A and 9B show a further construction of the vertical side frames 11 and 11'. The modified side frame 55 as hereinshown is provided with a center post 56 and an end post 57. Short transverse horizontal attachment rods 58 extend between the end post and the center post. Accordingly, only half of the side frame is provided with attachment rods to support shelving or other type accessories as disclosed herein and obvious to a person skilled in the art. The attachment rods 58 also extend on both sides of the posts 56 and 57 as illustrated in FIG. 9B.

Figure 10:
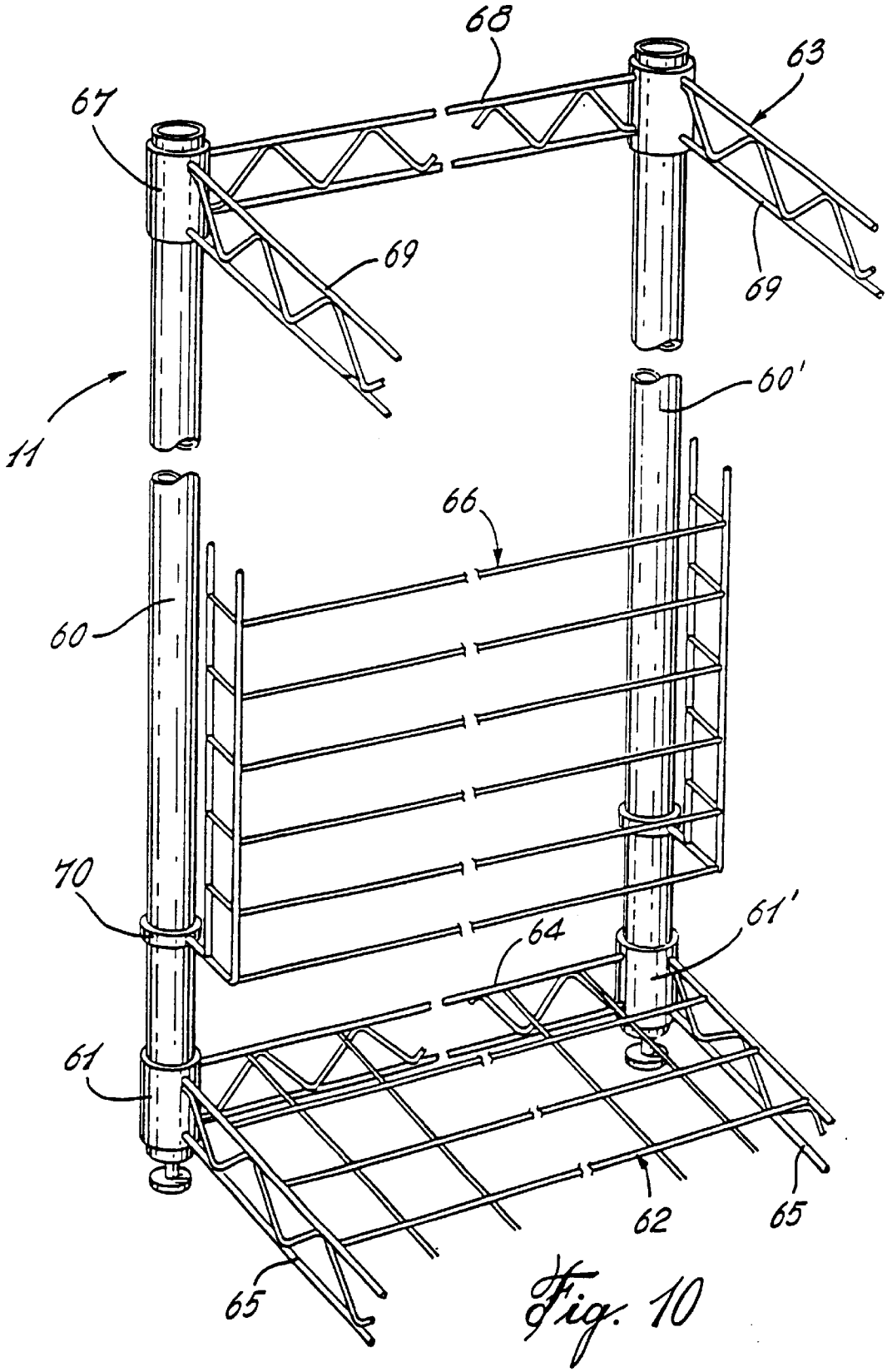
FIG. 10 is a perspective view showing a modification of the display rack and particularly the post and the cross-frames.

FIG. 10 shows a further modification wherein the side posts 60 and 60' are round posts and provided with attachment sleeves 61 in the corners of a lower shelf 62 and a top interconnecting frame 63. The shelves have transverse end trusses 64 and side trusses 65 for reinforcement. The side trusses 65 constitute the crossframes such as cross-bars 15 and 15' illustrated in FIG. 1. This round post design is well known in the art but not when used in the present wire display rack system.

The top of the side posts 60 and 60' of the side frames 11 are also interconnected together and with the posts of the other frame 11' (see FIG. 1) by the top interconnecting frame 63 comprised of attachment sleeves 67, a cross-wire truss 68 and a pair of side wire trusses 69. Only one end of the frame is herein shown but the other end is identical. Further, the pair of side wire trusses 69 could be replaced by a single central wire truss, as is obvious to a person skilled in the art. The transverse horizontal attachment rods 66 are secured to the posts 60 and 60' by top and bottom clips 70 or could be welded thereto.

It is pointed out that it is within the ambit of the present invention to cover any obvious modifications of the preferred embodiment described herein provided such modifications fall within the scope of the appended claims.

What is claimed is:

1. A multi-configurational wire-rod display rack for mounting on a floor surface comprising two or more display modules, each module having at least two vertical side frames, each side frame having two spaced-apart vertically extending end posts, a plurality of transverse horizontal attachment rods immovably secured between said end posts of said side frames, said end posts being interconnected at a top end by a transverse top horizontal member, said vertical side frames being immovably interconnected together in spaced parallel relationship by lower connecting cross-bars secured between a respective forward and rearward one of said end posts of said two spaced-apart vertically extending end posts, a top interconnecting member secured between said transverse top horizontal members of said vertical side frames, said horizontal attachment rods being elongated U-shaped rods defining opposed right angle end sections and an elongated intermediate straight section, said end sections being connected to a respective one of said two spaced-apart vertically extending end posts with said intermediate straight section disposed horizontally to one side and between said vertically extending end posts at a predetermined distance therefrom to form a clearance gap, a plurality of wire-rod product support-and-display accessories removably supported between said U-shaped rods without the use of fasteners and spanning said at least two vertical side frames, one of said vertical side frames being an intermediate side frame of a two or more module display rack structure, said intermediate side frame having said U-shaped rods projecting on opposed sides thereof with said U-shaped rods on opposed sides aligned with one another in horizontal planes.

2. A multi-configurational wire-rod display rack as claimed in claim 1 wherein said top interconnecting member is a top connecting cross-bar.

3. A multi-configurational wire-rod display rack as claimed in claim 2 wherein said transverse top horizontal member and said end posts are integrally formed by a bent rigid tubular rod.

4. A multi-configurational wire-rod display rack as claimed in claim 3 wherein said tubular rod is a metal hollow rod of square cross-section.

5. A multi-configurational wire-rod display rack as claimed in claim 2 wherein said wire-rod product support-and-display accessories are provided with wire hooks integrally formed therewith for attachment to said horizontal attachment rods.

6. A multi-configurational wire-rod display rack as claimed in claim 5 wherein said accessories are one of wire shelving, wire baskets, wire peg boards, wire hangers, wire partitions, or other wire accessories.

7. A multi-configurational wire-rod display rack as claimed in claim 6 wherein one of said accessories is a wire-rod peg board comprised of a plurality of horizontally spaced parallel horizontal wire rods welded to transverse rods to form a rectangular panel, U-shaped wire hooks each defining a mouth opening projecting from respective corners of said panel for receiving therein one of said horizontal attachment rods.

8. A multi-configurational wire-rod display rack as claimed in claim 2 further comprising a caster secured to a bottom end of each of said vertically a extending end posts.

9. A multi-configurational wire-rod display rack as claimed in claim 2 wherein said end posts are disposed side-by-side and are interconnected by one or more module securable clamps.

10. A multi-configurational wire-rod display rack as claimed in claim 2 wherein two or more modules of said display rack are interconnected together by said interconnecting member and said lower connecting cross-bars.

11. A multi-configurational wire-rod display rack as claimed in claim 2 wherein there are two or more of said display modules disposed and interconnected end-to-end to form a display rack structure, said two spaced-apart vertically extending end posts of adjacent modules being interconnected by one or more module securable clamps.

12. A multi-configurational wire-rod display rack as claimed in claim 2 wherein there are two or more of said display racks interconnected side-by-side or end-to-end in aligned relationship and interconnected by a plurality of module securable clamps securing vertically extending end posts of adjacent racks together to form a multi-module display rack accessible from all four sides thereof.

13. A multi-configurational wire-rod display rack as claimed 1 wherein said horizontal attachment rods are secured between said end posts in equidistantly spaced parallel relationship and extend a predetermined distance from said transverse top horizontal member to said lower connecting cross-bars.

14. A multi-configurational wire rod display rack as claimed in claim 1 wherein said two or more module display rack structure of said display rack are interconnected together by said interconnecting member and said lower connecting cross-bars.

15. A multi-configurational wire-rod display rack as claimed in claim 1 wherein said vertically extending end posts are of circular cross-section.

16. A multi-configurational wire-rod display rack as claimed in claim 1 wherein said interconnecting member is a top interconnecting frame secured to said vertically extending end posts and having at least one reinforced truss member.

* * * * *